US010411349B2

(12) United States Patent
Black et al.

(10) Patent No.: US 10,411,349 B2
(45) Date of Patent: Sep. 10, 2019

(54) SYSTEMS AND METHODS FOR REDUCING INTERMODULATION FOR ELECTRONICALLY CONTROLLED ADAPTIVE ANTENNA ARRAYS

(71) Applicant: Elwha LLC, Bellevue, WA (US)

(72) Inventors: Eric J. Black, Bothell, WA (US); Brian Mark Deutsch, Snoqualmie, WA (US); Alexander Remley Katko, Bellevue, WA (US); Melroy Machado, Seattle, WA (US); Jay Howard McCandless, Alpine, CA (US); Yaroslav A. Urzhumov, Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 634 days.

(21) Appl. No.: 15/077,703

(22) Filed: Mar. 22, 2016

(65) Prior Publication Data

US 2017/0279196 A1 Sep. 28, 2017

(51) Int. Cl.

| | |
|---|---|
| ***H01Q 3/36*** | (2006.01) |
| ***H01Q 1/36*** | (2006.01) |
| ***H01Q 21/00*** | (2006.01) |
| ***H01Q 3/26*** | (2006.01) |

(52) U.S. Cl.

CPC ..... *H01Q 3/36* (2013.01); *H01Q 1/36* (2013.01); *H01Q 3/2605* (2013.01); *H01Q 21/00* (2013.01)

(58) Field of Classification Search

CPC ..... H01Q 1/36; H01Q 3/2605; H01Q 3/36; H01Q 21/00

See application file for complete search history.

(56) References Cited

U.S. PATENT DOCUMENTS

| | | | | |
|---|---|---|---|---|
| 5,027,127 | A | 6/1991 | Shnitkin et al. | |
| 5,557,286 | A | 9/1996 | Varadan et al. | |
| 6,377,217 | B1 | 4/2002 | Zhu et al. | |
| 9,413,066 | B2 | 8/2016 | Zhu et al. | |
| 9,647,345 | B2 | 5/2017 | Hyde et al. | |
| 9,711,866 | B1 * | 7/2017 | Doane | H01Q 19/13 |
| 2010/0033389 | A1 | 2/2010 | Yonak et al. | |
| 2010/0328142 | A1 * | 12/2010 | Zoughi | G01S 7/025 342/179 |
| 2014/0211298 | A1 | 7/2014 | Sayyah et al. | |
| 2014/0266897 | A1 | 9/2014 | Jakoby et al. | |
| 2015/0295309 | A1 | 10/2015 | Manry, Jr. et al. | |
| 2015/0380789 | A1 | 12/2015 | Jakoby et al. | |
| 2016/0056373 | A1 | 2/2016 | Goktepeli et al. | |

(Continued)

OTHER PUBLICATIONS

PCT International Search Report; International App. No. PCT/US2017/023641; dated Jul. 4, 2017; pp. 1-5.

*Primary Examiner* — Lewis G West

(57) ABSTRACT

The present disclosure provides a system and methods for mitigating, or reducing, the intermodulation of an adaptive antenna array's radiating elements. A tunable element may be used with a bias component to increase linearity of the system. These tunable elements may modify a radiating element's capacitance or damping rate. Adjusting the shape of the radiating element or using switches may also modify the resonance strength. Variable couplers may further be added to a system to reduce intermodulation. An adaptive antenna array using the techniques described herein may have all or some of the elements co-located.

20 Claims, 5 Drawing Sheets

(56) References Cited

U.S. PATENT DOCUMENTS

| | | | | |
|---|---|---|---|---|
| 2016/0141754 | A1 | 5/2016 | Leyh et al. | |
| 2016/0261043 | A1* | 9/2016 | Sazegar | H01Q 3/34 |
| 2017/0003389 | A1* | 1/2017 | Brady | G01S 13/887 |
| 2017/0279196 | A1 | 9/2017 | Black et al. | |

* cited by examiner

SYSTEMS AND METHODS FOR REDUCING INTERMODULATION FOR ELECTRONICALLY CONTROLLED ADAPTIVE ANTENNA ARRAYS

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc., applications of the Priority Application(s)). In addition, the present application is related to the "Related Applications," if any, listed below.

TECHNICAL FIELD

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc., applications of such applications are also incorporated by reference, including any priority claims made in those applications and any material incorporated by reference, to the extent such subject matter is not inconsistent herewith.

PRIORITY APPLICATIONS

None

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

TECHNICAL FIELD

This disclosure relates to systems and methods for reducing intermodulation. More specifically this disclosure relates to intermodulation-reducing techniques for electronically controlled adaptive antenna arrays.

SUMMARY

An antenna system may include a shared feed with an adaptive array of unit cells. Each unit cell may comprise a radiating element and a tunable element co-located with each of the radiating elements. A bias component may be used to provide a DC bias for each tunable element. The DC bias for each tunable element may be selected to increase the linearity of operation of the tunable element to reduce signal intermodulation. An activation component may be used to control the activation or a degree of radiation of the radiating elements in response to energy in the shared feed by tuning the tunable element of the radiating elements.

One or more solutions may be employed to reduce intermodulation. For instance, resonance frequency may be modified by variable capacitors. In another embodiment, the Q-factor (e.g., the damping rate of a resonator) can be modulated with a variable resistor. In another embodiment, resonance strength can be varied by virtue of switches that activate/deactivate certain parts of the resonant element. In some embodiments, the input power may be controlled in each element with a dedicated variable coupler.

DETAILED DESCRIPTION

Figure 1:
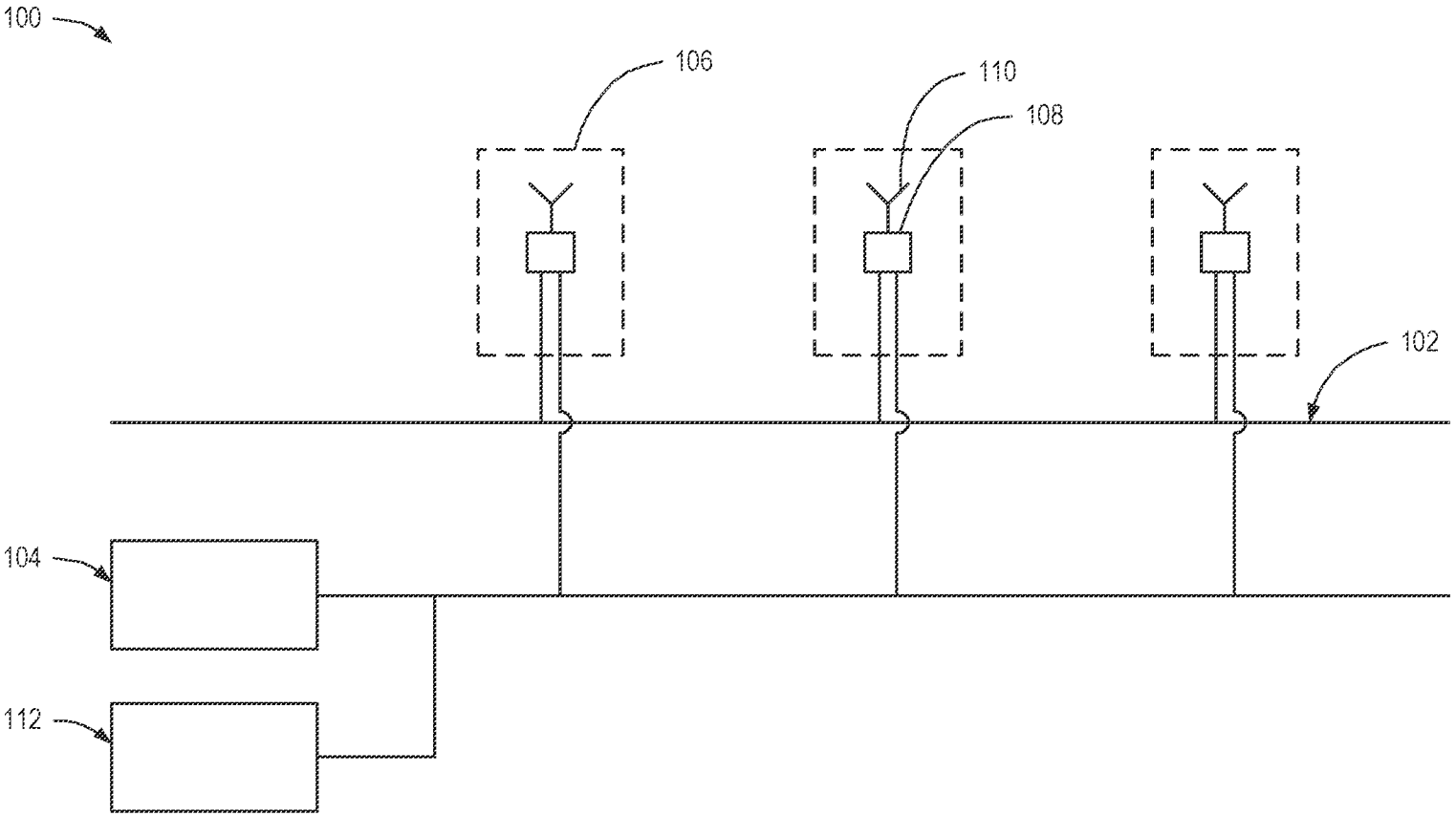
FIG. 1 illustrates an antenna system comprising tunable elements to reduce signal intermodulation, according to one embodiment.

Various embodiments, systems, apparatuses, and methods are described herein that relate to reducing passive intermodulation and intermodulation distortion. The embodiments described herein may allow elements that are typically separated by a distance to be co-located.

For example, adaptive antenna arrays (A3s) form the basis of various beamforming and electronically steerable antennas, which are rapidly penetrating various areas of wireless communications. They are also used as MIMO systems, where the multiple antenna elements serve to control channel gains, for signal diversity in multipath scenarios, and/or for spatial multiplexing. Common approaches for controlling A3s is by virtue of having electronic switches, electronically controlled variable capacitors (varicaps), variable resistors, phase shifters and other electronic circuit elements which change their electromagnetic characteristics depending on the voltage level on the control port(s). When A3s equipped with such control elements are used for wireless communications, i.e., for transferring digitally encoded information, extremely high linearity of the transmitter and receiver antenna is desired.

This is especially important for high-power and/or frequency division duplexing (FDD) systems due to passive intermodulation (PIM). Co-location of high-power transmit systems with receive systems in other bands can produce intermodulation distortion (IMD) even without highly nonlinear components such as transistors and varactors. In fact, IMD can be produced by purely passive system components including loose RF connections and even rusty bolts. This PIM limits the maximum information throughput rates achievable with such adaptive antennas. High-order, high spectral efficiency digital modulation schemes such as OFDM tend to have a high peak-to-average power ratio (PAPR), and are therefore more susceptible to IMD and PIM.

Due to the power levels possible with some wireless communications transmitters, PIM must be highly suppressed. For example, typically PIM levels on the order of −150 dBc are desired for commercial systems. This requirement for extremely high linearity has typically precluded the use of circuit components such as varactors and varicaps for realizing A3s in such systems, because including these components would cause PIM. If such components were used in a system, they must often be located separately, taking up additional space. Reducing the interference using the systems and methods described herein can eliminate this need.

Linearity of a system may be achieved by adapting various parameters of the resonant elements. Adaption in resonant element-based A3s may be achieved by modulating resonance frequency ($\omega_r$); Q-factor of the resonance, or equivalently, its damping rate $\gamma=\omega_r/2Q$; and/or resonance strength F (which, in the case of an electric- or magnetic-dipole resonator, corresponds to the square of the dipole moment normalized by the excitation intensity).

In addition, non-resonant as well as resonant radiating elements can provide adaption by modulating the power coupling level ($T_c$) between the radiating element and its feed. The existence of this parameter as a separate degree of freedom implies that there is a (possibly very short) transmission line between the shared (corporate) feed and the radiating resonant element, which allows one to have a certain level of isolation between the parameters of the Lorentzian resonator and the amount of power allowed into the radiating resonant element. In addition, with this type of architecture, the tunable element(s) controlling the value of $T_c$ can be co-located with the corporate (shared) feed structure, but spatially separated from the radiating resonator, especially from its upper (radiating) surface radiating into free space.

Resonance frequency, Q-factor, and v resonance strength correspond to the three parameters defining a Lorentzian resonance, which has a response curve of the form:

$$E_{rad} = \frac{F}{\omega(\omega + i\gamma) - \omega_r^2} E_{exc}, \quad \text{(Eq. 1)}$$

Power coupling level describes the intensity of excitation incident upon the radiating element; in other words, power coupling level further expresses $E_{exc}$ in the form $E_{exc}=T_cE_{in}$, where $E_{in}$ is the field in the (typically shared) feed directly underneath the resonant element. Power coupling level and resonance strength achieve similar result in terms of controlling the radiated amplitude. Therefore, in some embodiments only one of these parameters may be modified for efficiency.

A parameter describing the linearity of particular devices is useful for quickly comparing the suitability of multiple candidate devices. One such parameter commonly used is a device's third order intercept point (IP3). A nonlinear device will cause spectral regrowth by generating frequency harmonics and mixing products. The IP3 is an extrapolation of the (input) power level at which the fundamental signal power level (with a frequency of $\omega_0$) is equal to the third order harmonic (with a frequency of $3\omega_0$). This parameter yields an estimate of how linear a particular device is.

Described herein are various embodiments that describe various PIM and IMD mitigation techniques related to the parameters described above.

In one embodiment, an electronically controlled adaptive antenna array system may have a shared feed. The system may further comprise an adaptive array of unit cells. Each of these unit cells may comprise a radiating element and a tunable element co-located with each of the radiating elements. Further, a bias component or biasing component may provide a DC bias for each tunable element. The DC bias for each tunable element may be selected to increase the linearity of operation of the tunable element to reduce signal intermodulation. Finally, an activation component may be configured to control the activation or the degree of radiation of the radiating elements in response to energy in the shared feed by tuning the tunable element of the radiating elements.

In some embodiments, a shared feed (e.g., a transmission line or waveguide) may be configured for microwave frequency electromagnetic waves, radio frequency electromagnetic waves, infrared electromagnetic waves, or optical frequency electromagnetic waves. In some embodiments, a conductor may be used for conducting a time-dependent current signal. In other embodiments, the shared feed may comprise a conductor for guiding a surface wave. In any embodiment, the adaptive array of unit cells may overlay the shared feed. The shared feed may additionally or alternatively be a radiator evanescently or reactively coupled to an adaptive array of unit cells and/or a radiator coupled radiatively to the adaptive array of unit cells.

The activation component may be configured to control radiation using a variety of methods. For example, the activation component may be configured to control radiation by imposing a modified voltage on top of the DC bias. In another embodiment, the activation component may control the radiation by providing a signal to an electrical terminal different than the terminal where the DC bias is applied. In yet other embodiments, the activation component is configured to control radiation by causing mechanical actuation of the tunable element and/or adjusting the phase of the tunable element.

The radiating elements of the system may comprise resonant elements. The tunable element corresponding to the radiating element is configured to modify a response of the resonant elements to the shared feed. This may control activation or a degree of radiation of the corresponding radiating element.

The tunable elements may be configured to adjust a resonant frequency of the corresponding radiating element. The activation component may be configured to selectively tune the tunable element of the corresponding radiating element to match a frequency within the shared feed to activate radiation of the radiating element.

In other embodiments, the tunable element is configured to selectively modify a capacitance or inductance of the radiating element. For example, the tunable element may be a variable capacitor based on a semiconductor junction. The variable capacitor may comprise a diode, or more specifically a varactor diode. In another example, the variable capacitor may be a transistor. More specifically, the tunable element may be a variable capacitor based on a ferroelectric material. In some embodiments, the ferroelectric material comprises Barium Strontium Titanate (BST). In yet another example, the tunable element may be a variable capacitor based on a liquid crystal medium.

In some embodiments, each of the tunable elements may be configured to adjust a quality factor of a resonance of a corresponding radiating element. For example, the tunable element may be a variable resistor. The variable resistor may be a resistor based on at least one semiconductor junction. Additionally, in some embodiments, the variable resistor may be a diode. The diode may have an intrinsic semiconductor region between a p-type semiconductor region and an n-type semiconductor region (PIN diode). In another embodiment, the variable resistor may be a transistor. For example, the transistor may be a field effect transistor (FET).

The transistor may be operated with a common source configuration with the gate terminal operating as a throw and a drain terminal and a source terminal operating as switched terminals. Alternatively, the variable resistor may be a high isolation between a gate terminal and alternating current signals.

In some embodiments, the radiating elements may be configured to reduce intermodulation. For example, the radiating element may further comprise one or more of a radio frequency choke and insulated control lines. As another example, the radiating elements are shunt reflective. The shunt may allow electric current to pass around another point in the circuit by creating a low resistance path such as a switch. This allows each radiating element to either conduct current or not, which then creates a two state radiating element. Linearity may determine whether a radiating element receives current. For example, a circuit may shunt current when a switch is less linear. An off state of a switch may be used to activate or control radiation of the radiating element. In yet another example, the embodiment may have a radiating on state of the radiating element corresponding to a switching off state of the tunable element corresponding to the radiating element.

In some embodiments, the tunable elements may be configured to adjust a resonance strength of the radiating element. For example, the tunable elements may adjust a resonance strength of an electric dipole or a magnetic dipole resonance. In another embodiment, the DC bias may deactivate or activate part of a resonant element of a corresponding radiating element. For example, the radiating element may have a plurality of conducting lines connected in series, and one or more of the conducting lines may be activated or deactivated based on the DC bias. This would effectively modify a length of the radiating element. Finally, the tunable element may be configured to adjust two or more of a quality factor of a resonance of a corresponding radiating element, a resonant frequency of the corresponding radiating element, and a resonance strength of the radiating element.

In some embodiments, the system may include a shared feed connected to an adaptive array of unit cells. Each unit cell may include a radiating element and an adjustment element co-located with the radiating element. The adjustment element may include one or more tunable materials, such as a phase change material and/or a state change material. A transition control component may be configured to selectively induce a change in an electromagnetic (e.g., electric or magnetic) property of the tunable material to control activation and/or a degree of radiation of the radiating element.

The tunable material may initially be in a first phase or a first state that is substantially nonresponsive to electromagnetic fields provided by the shared feed. The second phase or state might also be substantially nonresponsive to electromagnetic fields from the shared feed. However, an activation state, transmissiveness, or degree of radiation may be modified from the first state to the second state.

The phase and/or state change material may include a material that transitions between discrete structural changes and material phase changes that result in discrete changes in one or more electric and/or magnetic properties of the tunable material. The tunable material may include a phase and/or state change material where the transition control component is configured to selectively induce a phase change in the phase and/or state change material.

The phase and/or state change material may be configured to transition between a first material phase and a second material phase. The phase and/or state change material may be a material whose electromagnetic characteristics depend on a current material phase of the phase and/or state change material. The electromagnetic characteristics of the phase and/or state change material may have a first dielectric constant in a first phase and a second dielectric constant in a second phase. The first dielectric constant may have a different real or imaginary part than the second dielectric constant.

The first phase may be a liquid phase and the second phase may be a gas phase. The first phase may be a crystalline solid and the second phase may be an amorphous solid. The first phase may be a liquid phase and the second phase may be a gas phase. The first phase may be a crystalline solid and the second phase may be an amorphous solid. The phase and/or state change material may be capable of forming multiple metastable allotropes. The first phase may be a first crystalline solid and the second phase may be a second crystalline solid. The phase and/or state change material may transition between multiple metastable phases. Multiple metastable phases may be able to exist within a common temperature range and a common pressure range.

The phase and/or state change material may be a reversible phase and/or state change material, such that after transition from a first metastable phase to a second metastable phase the phase change transition is reversible back to the first metastable phase. The phase and/or state change material may be a chalcogenide material, such as one or more of GeTe, GeSbTe, AgInSbTe, InSe, SbSe, SbTe, InSbSe, InSbTe, GeSbSe, GeSbTeSe, and AgInSbSeTe.

The first metastable phase may be an amorphous solid phase and the second metastable phase may be a crystalline solid phase. The phase and/or state change material may be electrically insulating in the first metastable phase. The phase and/or state change material may be a poor conductor, such as a semiconductor, a semimetal or a low-conductivity metal, in the second metastable phase. The second material phase may require one or more of a different temperature, a different pressure, a different electric field, or a different magnetic field to maintain the phase and/or state change material in its second phase.

The first material phase and the second material phase may have different electronic bond structures. The phase transition in the phase and/or state change material may involve migration of atoms or ions between the phase and/or state change material and a second medium. The phase and/or state change material may be a super-conducting material in one of two possible phases, such that the phase change is between a superconducting phase and a non-superconducting (normal) phase. For example, the phase and/or state change material may be vanadium dioxide (VO2).

The transition between the first material phase and the second material phase may be a transition between two allotropic modifications. A reversible phase transition in the phase and/or state change material may include a migration of ions between the phase and/or state change material and a second medium in either direction. The ions may include oxygen ions or oxygen-containing molecular ions, for example. The transition control component may be configured to provide heating or cooling to the phase and/or state change material for a temperature-induced transition from a first material phase to a second material phase.

The transition control component is configured to selectively activate heating or cooling elements co-located with the unit cells to induce or maintain the transition. The temperature-induced transition may be a first-order transition between two or more of a solid phase, a liquid phase, a gas phase, and a plasma phase. The temperature induced transition may be a second-order transition between two solid allotropes. The temperature induced transition may be a transition between a ferromagnetic phase and non-ferromagnetic phase.

The temperature induced transition may be a transition between a superconducting phase and a non-superconducting phase. The temperature induced transition may be a transition between a paraelectric phase and a ferroelectric phase. The temperature induced transition may be a chemical reaction whose energy barrier is overcome above a certain temperature. The phase and/or state change material may be a pyroelectric material, wherein the temperature induced transition comprises a modification of electric polarization of the pyroelectric material as a function of temperature.

The transition control component may increase or reduce pressure on the phase and/or state change material to induce a transition from the first material phase to the second material phase. The transition control component may selectively activate a micro-electro-mechanical system (MEMS) co-located with a unit cell to induce or maintain an increased or a reduced pressure on the phase and/or state change material to maintain the transition.

The transition control component may increase or reduce an electric field incident on the phase and/or state change material to induce and/or maintain a transition from a first material phase to a second material phase. The phase and/or state change material comprises a ferroelectric material, and the transition may be between states without and with a remanent polarization. For example, the ferroelectric material may be one or more of BaTiO3, PbTiO3, and PZT. The phase and/or state change material comprises an antiferroelectric material and/or a multiferroic material. The phase and/or state change material may be a ferromagnetic material, a ferrimagnetic material, an antiferromagnetic material, and/or a multiferroic material. The transition control component may selectively activate an electromagnet co-located with the unit cell. As previously discussed, the material may be a state change material instead of a phase and/or state change material The state change material may be a material that continuously changes the electromagnetic property in response to an applied stimulus. For example, the state change material, wherein the transition control component is configured to selectively induce a continuous or gradual change in the electromagnetic property of the state change material. The state change material may be configured to transition between a first state with a first set of electric and/or magnetic properties and a second state with a second set of electric and/or magnetic properties in response to a change in one or more of a temperature, a pressure, an electric field, and a magnetic field.

The state change material may include a paraelectric material, such as one or more of SrTiO3 and BaSrTi, or a ferroelectric material, such as one or more of BaTiO3, PbTiO3, and PZT. The phase and/or state change material or state change material may be a phase and/or state change material with at least one phase being a state change material. For example, the tunable dielectric material may change its phase from ferroelectric, which can change phases from polarized to non-polarized by virtue of an applied E-field, to paraelectric, which has an E-field dependent dielectric constant.

The radiating elements may be resonant elements. The adjustment element may be a radiating element configured to modify a response of the resonant elements to the shared feed to control activation or a degree of radiation of the corresponding radiating element. Each of the adjustment elements may adjust a quality factor of a resonance of a corresponding radiating element. In various embodiments, the shared feed comprises a conductor for conducting a time-dependent current signal. The shared feed comprises a surface-bounded structure for guiding a surface wave. Additionally, in some embodiments the adaptive array of unit cells may overlay the shared feed.

FIG. 1 illustrates an antenna system 100 comprising tunable elements 108 to reduce signal intermodulation, according to one embodiment. The antenna system 100 may comprise a shared feed 102, a bias component 104, an activation component 112, and an adaptive array of unit cells 106.

Each unit cell 106 may further comprise one or more tunable elements 108 co-located with each of the radiating elements 110.

In some embodiments, the tunable element 108 may be configured to modify the capacitance and/or inductance of the resonant element. By modifying the capacitance and/or inductance, the resonance frequency of the radiating elements 110 may be modulated to reduce signal intermodulation. For example, because of the tunable element 108, the resonance of each unit cell 106 may be changed, which may allow certain unit cells to be turned off or on to increase linearity of the system as a whole.

For instance, the tunable element 108 may be a variable capacitor. In some embodiments, the variable capacitor may comprise a semiconductor junction made of diodes and transistors. However, semiconductor junctions are inherently nonlinear. In order to reduce the nonlinearity, a DC voltage from the bias component 104 may be used to bias the capacitor at a particular state. For example, each unit cell 106 may be tuned to a frequency that reduces the nonlinearity and signal intermodulation by changing the voltage across the semiconductor junction.

While variable capacitors allow the frequency of the unit cells 106 to be altered, they will be the dominant source of IMD and thus PIM in an A3 if used. So reducing the PIM and IMD produced by the variable capacitors will reduce the overall PIM and IMD of the A3.

One technique to reduce IMD and PIM is to select an appropriate DC bias point. For example, a varactor diode based on a p-n junction has a capacitance-voltage (CV) relation of the form $$C_j(V_R) = \frac{C_{j0}}{\left(1 + \frac{V_R}{\phi}\right)^{\gamma}}$$

where $C_{j0}$ is the zero-bias junction capacitance, $\phi$ is the contact potential which depends on the semiconductor, $\gamma$ is a parameter dependent on the junction structure (abrupt or hyperabrupt, etc.), and $V_R$ is the reverse-bias voltage.

The CV characteristics of such a device are determined by the reverse bias voltage, which is comprised of a DC voltage V_DC and an imposed RF voltage V_RF. In the small-signal limit, V_RF<<V_DC, so the DC bias voltage dominates the CV characteristic. In the vicinity of a particular bias point $V_{DC}$, a Taylor series may be used to approximate the CV characteristic. For example, $C(V-V_{DC})=C_0+C_1(V-V_{DC})+C_2(V-V_{DC})^2+C_3(V-V_{DC})^3+\ldots$. As shown, the coefficients $C_0$, $C_1$, $C_2$, $C_3$, . . . depend on $V_{DC}$. Therefore, by selecting an appropriate DC bias voltage range, PIM and IMD may be reduced by a variable capacitor device.

The DC bias may be selected based on desirability of tunability and linearity. For example, in some embodiments the bias component 104 may provide a low DC voltage. Such an embodiment would provide high tunability, but would also be highly non-linear. Therefore, in embodiments where linearity is more desirable, the DC bias may be set to a higher voltage. As the bias voltage is increased, the voltage from the activation component 112 may also be increased. The bias may be adjusted according to the requirements of a particular application.

In some embodiments, the variable capacitors may be made of ferroelectric materials, such as Barium Strontium Titanate (BST). Devices based on BST are typically much more linear than many semiconductor junction-based devices. A typical BST variable capacitor might have an IP3 on the order of +60 dBm=1 kW. This value is significantly higher than a typical specification for a semiconductor junction variable capacitor. Thus, the use of a BST variable capacitor would reduce the PIM generated by an A3.

In another embodiment, variable capacitors based on liquid crystal (LC) materials may be used. The tunability of LC-based variable capacitors is based on applying an electric field to alter the orientation of LC molecules. Because LC molecules must reorient in response to the field, their inertial characteristics determine how quickly they can respond to an applied field. If AC electric field of frequency $\omega$ were applied to an LC-based variable capacitor, the tunability of an LC molecule is a function of $\omega$. At high frequencies, the LC molecules cannot reorient within one period $2\pi/\omega$. Thus, LC-based variable capacitors cannot tune in response to an applied field above a certain frequency.

Once again, a Taylor series may be used to approximate the CV characteristic, for example, $C(V-V_{DC})=C_0+C_1(V-V_{DC})+C_2(V-V_{DC})^2+C_3(V-V_{DC})^3+\ldots$. As shown, the coefficients $C_0$, $C_1$, $C_2$, $C_3$, . . . depend on $V_{DC}$. Here, the coefficients are C_1,C_2,C_3, . . . <<C_0. Also, C_0 depends only on the DC bias point. With C_0 dominating the CV characteristic, variable capacitors based on LC have very low nonlinearity and are thus suitable for reduced PIM and IMD in A3s. LC-based variable capacitors have a limited switching time. Therefore, it may be suitable for embodiments with slower switching time requirements.

Similarly, any metamaterial that changes its effective dielectric constant at microwave frequencies, as a function of some external stimulus may be used. For example, stimuli could comprise mechanical vibrations, acoustic waves, light, magnetic field, electric field at lower frequencies, RF, or DC bias. These fields may allow re-orientation of a molecule, nano-particle, nano-cluster, micro-particle, etc. This would allow certain embodiments to reduce PIM.

Switched arrays of fixed capacitors may also be employed. These variable capacitors have a discrete set of possible capacitance values they can assume (typically a power of 2), whereas variable capacitors based on BST or semiconductor junctions may apply the DC bias voltage to the same terminals at which the variable capacitance is desired. Switched capacitor arrays typically have a more complex control system than a simple DC bias. Control signals are used with a common and/or proprietary format, such as a serial peripheral interface (SPI) bus, controlling the switches and thus the overall capacitance. This control method provides a convenient way to select from a discrete number of states and enables easy control of an array of switches. It has the added benefit of decoupling the control from an applied AC voltage. Referring to the Taylor series approximation, the coefficients C_n are weakly dependent on the applied voltage and strongly dependent on the switch matrix state. This results in significantly reduced nonlinearity and thus improved PIM and IMD. An array of fixed capacitors based on semiconductors can offer an IP3 on the order of +65 dBm=3 kW, a significant improvement over variable capacitors with a DC control bias applied directly as in a varactor diode.

Moreover, this can be improved by using appropriate fixed capacitors with enhanced linearity. Microelectromechanical systems (MEMS) capacitors offer very high linearity, as their operation is based on mechanical geometry and separation. Using a switched array of MEMS capacitors can yield very linear devices: in particular they can result in IMD (note not IP3)<−130 dBc and potentially <−150 dBc.

For example, the bias component 104 or the control can be decoupled from the shared feed 102. This would increase linearity over a two terminal device, like a diode or a BST capacitor, because the bias component 104 does not apply the DC voltage at the same place as the RF voltage. The switched array of fixed capacitors can also be made of significantly more linear material. For example, any kind of conventional capacitor may be used. Thus such an embodiment may provide a linear way of electronic switching.

In another embodiment, variable capacitors based on MEMS may be used as the tunable element. MEMS-based variable capacitors achieve tuning through mechanical deformation. This deformation can be achieved through a variety of mechanisms, including but not limited to electrostatic, magnetostatic, and piezoelectric. MEMS variable capacitors have enhanced linearity compared to semiconductor junctions for multiple reasons. First, actuation methods not based on AC electric fields (such as piezoelectric) offer a method of decoupling the control signal from the RF voltage. Decoupling the control and RF signals may lead to enhanced linearity. Second, a MEMS variable capacitor depends on mechanical deformation. Such a mechanical system will possess substantial inertia (mass), and the amount of this inertia can be easily adjusted by choosing the proper dimensions of the deformable elements. A MEMS variable capacitor will also not be able to reorient in response to arbitrarily high frequencies. Therefore, using a MEMS variable capacitor would lead to high linearity.

Alternatively, the tunable element 108 could be configured to modulate the dampening rate of the radiating elements 110. For example, variable resistors based on semiconductor junctions or phase-change materials (PCM) may be used.

In embodiments utilizing variable resistors based on semiconductor junctions, the junctions may be comprised of diodes and transistors. For instance, field effect transistors (FETs) of various types and PIN diodes may be used for Q-switching at high frequencies. Transistors such as metal-oxide semiconductor FETs (MOSFETs) and pseudomorphic high electron mobility transistors (pHEMTs) may also be used due to excellent frequency characteristics, but they do not generally offer good PIM performance.

Such FETs are often operated in a common source configuration, with the gate operating as the throw of the switch and the drain and source operating as the switched terminals. This configuration is sensitive to induced AC voltage on the gate, which can result in mixing at the drain of the FET. This results in PIM and IMD if the gate is not sufficiently isolated from AC signals.

To improve the PIM and IMD performance, a FET-based switching A3 high isolation between the gate and any AC signals may be used. In some embodiments, this may be accomplished by adding RF chokes and ensuring that any DC control lines are not susceptible to induced AC voltage. To further increase linearity, appropriate bias conditions for the FET may be selected. The IP3 of a FET depends on the voltage across the switching terminals V_DS, the control voltage V_GS, and the current drawn from the drain I_DS. For a given FET, selecting a particular bias condition can increase the linearity, as measured by the IP3, by 6 dB or more.

In another embodiment, PIN diodes may be used for Q-switching at high frequencies. While they are two-terminal devices and thus the DC control bias is applied to the switched terminals, the physics of operation of a PIN diode result in increased linearity compared to a varactor diode. A typical PIN diode may have an IP3 on the order of +40 dBm=10 W. PIN diodes are thus more suitable for better PIM and IMD performance than many FETs.

The linearity in such embodiments may be improved by using both FETs and PIN diodes when the radiating element 110 is shunt-reflective. For example, a two-state radiating element (on or off) may be used for the tunable element 108 such that the switch is either the same or complementary to the radiating state. That is, when the switch is in the on-state, the radiating element 110 may be designed to be in either the on- or the off-state.

A particular switching device may provide improved linearity in either the on- or the off-state. For example, a switch that is more linear in the off-state may be selected. In such an example the radiating element is designed such that the radiating on-state corresponds to the switching off-state, with the switch positioned such that it provides a reflective shunt. In this case, the switch operates in a higher linearity mode when the element is radiating. The radiating off-state corresponds to the switching on-state. In the switching on-state, the switch provides a through shunt. Thus, the more nonlinear mode of the switch results in IMD that is not radiated at the element because it is shunted.

In another embodiment, variable resistors based on phase-change materials (PCM) may be used for the tunable element 108. The PCM used may be a variety of materials whose characteristics depend on their phase (in a material or matter sense). These include familiar phases such as liquid and gas, as well as finer distinctions such as crystalline and amorphous solid, or even finer distinctions such as crystalline polymorphism (ability to have multiple metastable allotropes). PCM may enable the switching of the complex dielectric constant between two states. The dielectric constants that are switched between may be distinct from each other by real, imaginary, or both parts of the dielectric constant (a quantity proportional to conductivity).

In some embodiments the PCM may transition between metastable states, with both states being able to exist at the same temperature and pressure. For example, chalcogenide materials, which are typically glasses (amorphous solids) may be used. This class of materials includes GeTe, GeSbTe, AgInSbTe, InSe, SbSe, SbTe, InSbSe, InSbTe, GeSbSe, GeSbTeSe and AgInSbSeTe, among others. In these embodiments, transitions occur typically between an amorphous (glassy) and crystalline state, where the amorphous state is essentially an insulator and the crystalline state is a semiconductor or a poor conductor. These two states have a very large contrast in conductivity as well as a usable contrast in the real part of the dielectric constant. The tunable element 108 of these embodiments may be switched between these states to increase linearity. These PCMs do not require any energy input to preserve them in either of the states; however, the transition times may not be fast enough for certain applications.

In another embodiment the PCM transitions between states where the two states require a different temperature, pressure, electric field, magnetic field and/or another physical stimulus. For example, vanadium dioxide (VO2) may be used. In VO2, the transition is between two allotropic modifications of rutile. At room temperature, VO2 is a monoclinic distorted rutile with the electronic band structure of a semiconductor; above 70 degrees C. it becomes a metal, resulting in a sharp increase in conductivity. In another example, superconductors can be used. Superconductors experience a dramatic increase in electrical conductivity below their critical temperature, a transition that is also affected by external magnetic fields and pressure. Thus, tunable elements 108 made of PCM materials may allow significant tunability by means other than electromagnetic fields.

Figure 2:
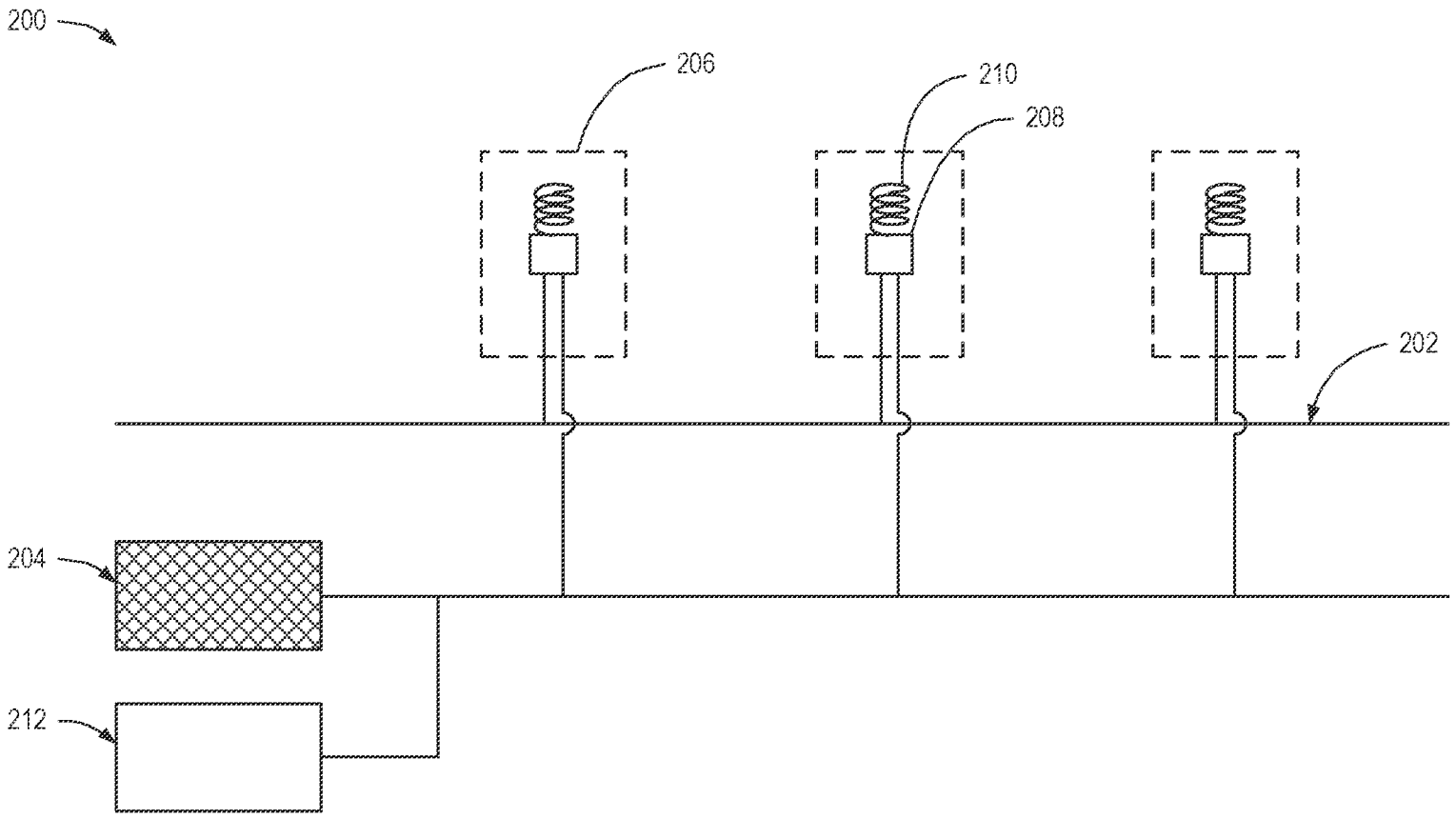
FIG. 2 illustrates an antenna system comprising flexible spiral radiating elements, according to one embodiment.

FIG. 2 illustrates an antenna system 200 comprising flexible spiral radiating elements 210, according to one embodiment. The antenna system 200 may comprise a shared feed 202, a bias component 204, tunable elements 208, an activation component 212, and an adaptive array of unit cells 206. In this and other embodiments, the bias component 204 and activation component 212 may control each tunable element 208 and/or unit cell 206 individually or in groups (contiguous or non-contiguous neighbors).

In one embodiment, the radiating element 210 contains a flexible spiral as part of the radiator as shown. The outer radius of the spiral can be mechanically adjusted by rotating either the inner or the outer anchor point. As a result, magnetic-dipole (MD) resonance strength (which is correlated with self-inductance of the spiral) changes to the extent that the area of a spiral element is modulated, and electric-dipole (ED) resonance strength (correlated with the self-capacitance) changes to the extent that the gap between consecutive turns is affected by the squeeze. Thus, the Resonance strength (F) of an electric-dipole (ED) or magnetic-dipole (MD) type resonance can be varied by the mechanical change of the spiral.

The radiating element 210 may be a different shape. For example, another embodiment may use a liquid metal alloy, with a reservoir that is filled up in different configurations, so it could be configured to be any shape. It could be a spiral, a dipole, or even be a patch. By changing the geometry, both the resonator strength and the resonance frequency can be changed.

The radiating element 210—for example, a square or circular spiral—may contain an arm comprising multiple conducting lines connected in series and interleaved with switches. The switches may be double electronic switches, mechanical switches, or other suitable switches. Further, they can be semiconductor-based, MEMS-based or simply mechanical.

The switches may be controlled to be either conducting (shorted) or insulating (open). Depending on the position of the first open switch, the effective length of the arm varies, as parts of it become electrically disconnected. Consequently, the inductance and the MD strength of the resonator including this arm can be tuned in several discrete steps. The number and magnitude of these steps depend on the number and length of these segments.

Figure 3:
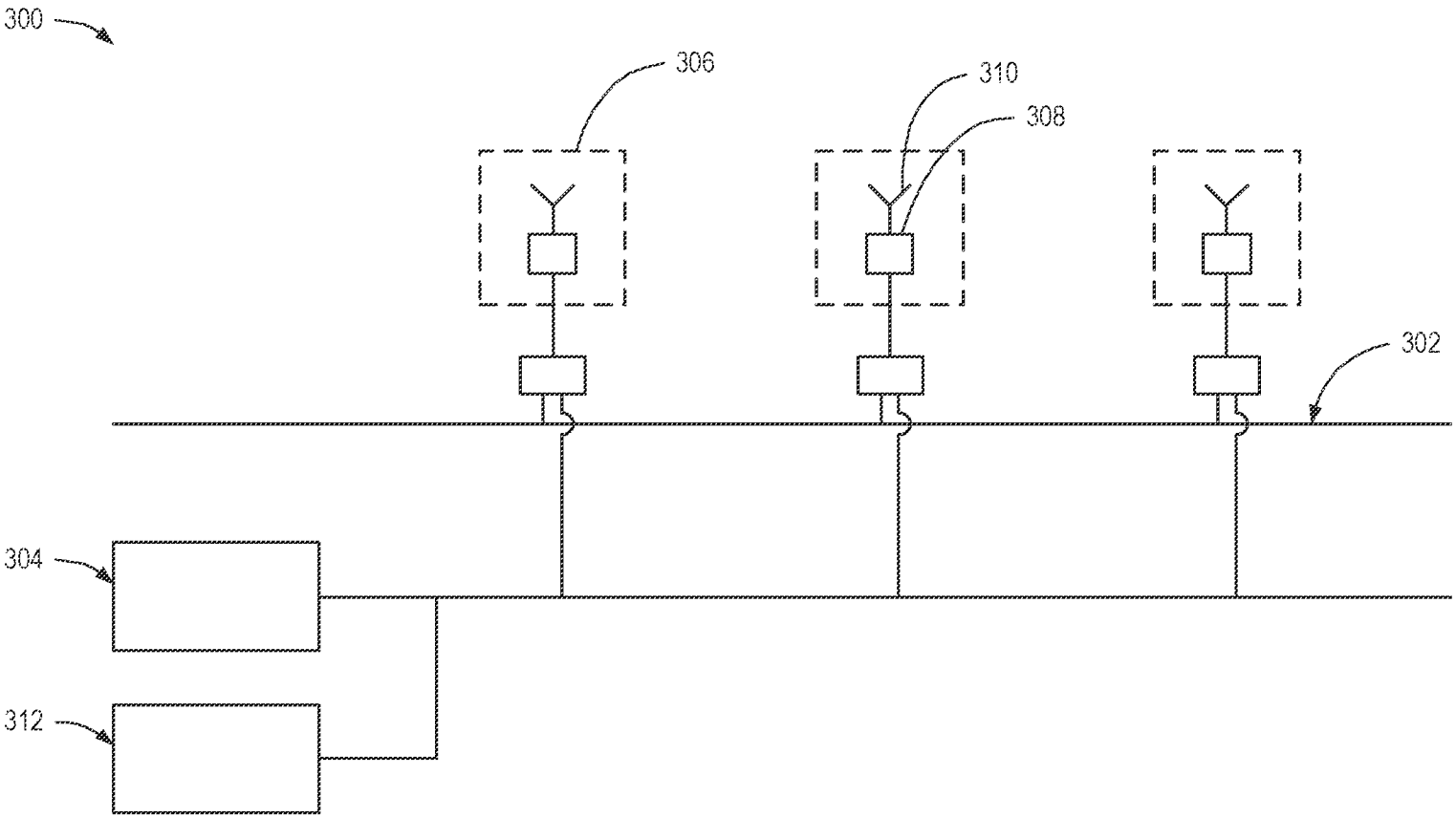
FIG. 3 illustrates an antenna system comprising variable couplers, according to one embodiment

FIG. 3 illustrates an antenna system 300 comprising variable couplers, according to one embodiment. The antenna system 300 may comprise a shared feed 302, a bias component 304, tunable elements 308, an activation component 312, and an adaptive array of unit cells 306. The variable couplers 314 may be configured to control the input power, and may be used in conjunction with the methods previously discussed. In some embodiments, the variable couplers may be based on switches.

Figure 4:
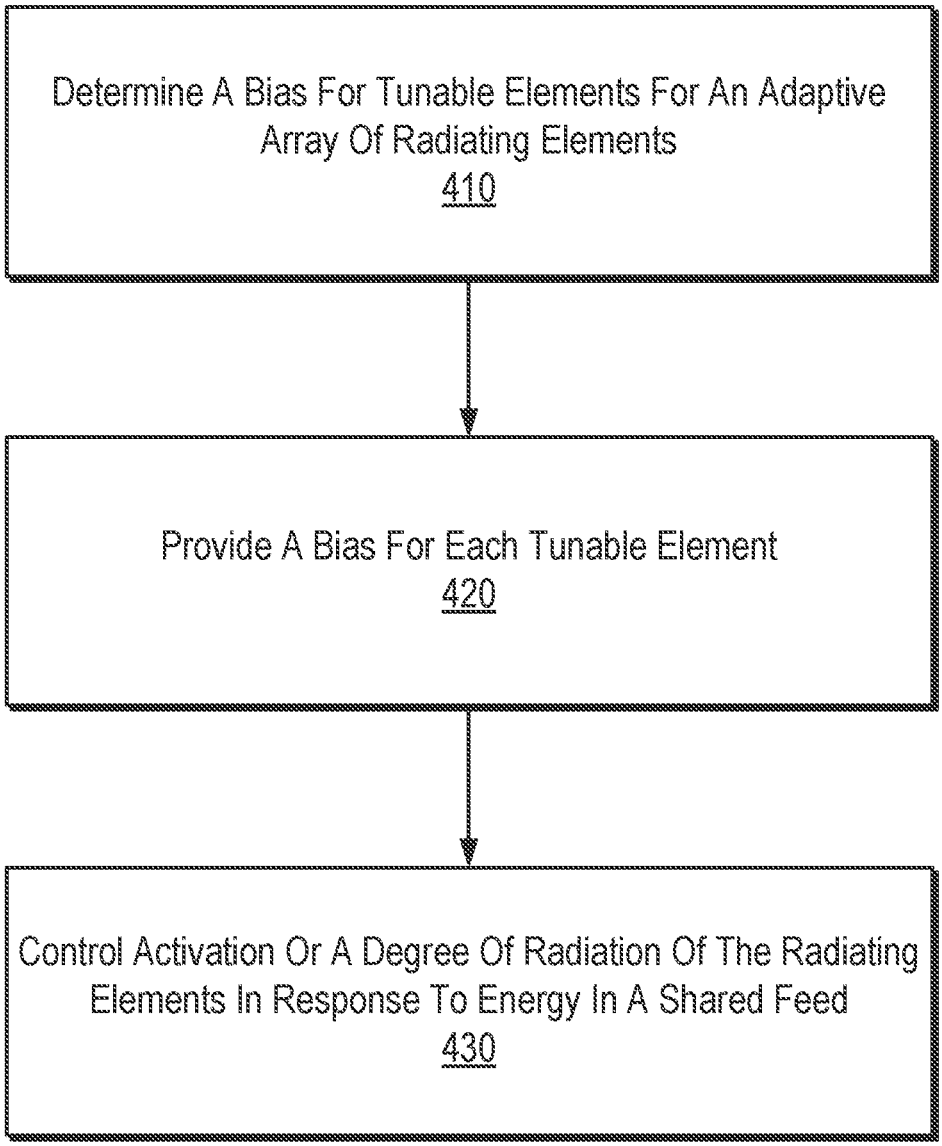
FIG. 4 illustrates a flow chart of one embodiment of a method for reducing signal intermodulation.

FIG. 4 illustrates a flow chart of one embodiment of a method for reducing signal intermodulation. The method illustrated may be computer-implemented via software and a processor or microprocessor. The method may be implemented as stored instructions on a transitory or non-transitory computer-readable medium that, when executed by one or more processors, causes the processor to implement operations corresponding to the methods described herein. The method may be implemented additionally, partially, or alternatively using an application specific integrated circuit, a field-programmable gate array, other hardware circuitry, integrated circuits, software, firmware, and/or a combination thereof.

As illustrated, a bias for tunable elements for an adaptive array of radiating elements may be determined 410. Each radiating element may comprise a tunable element co-located with each of the radiating elements. Further, the adaptive array of radiating elements may overlay a shared feed. The bias may be provided for each tunable element 420. The bias for each tunable element is selected to increase linearity of operation of the tunable element to reduce intermodulation between the radiating elements. The activation or a degree of radiation of the radiating elements may be controlled 430. This may be done in response to energy in the shared feed by tuning the tunable element of the radiating elements.

Figure 5:
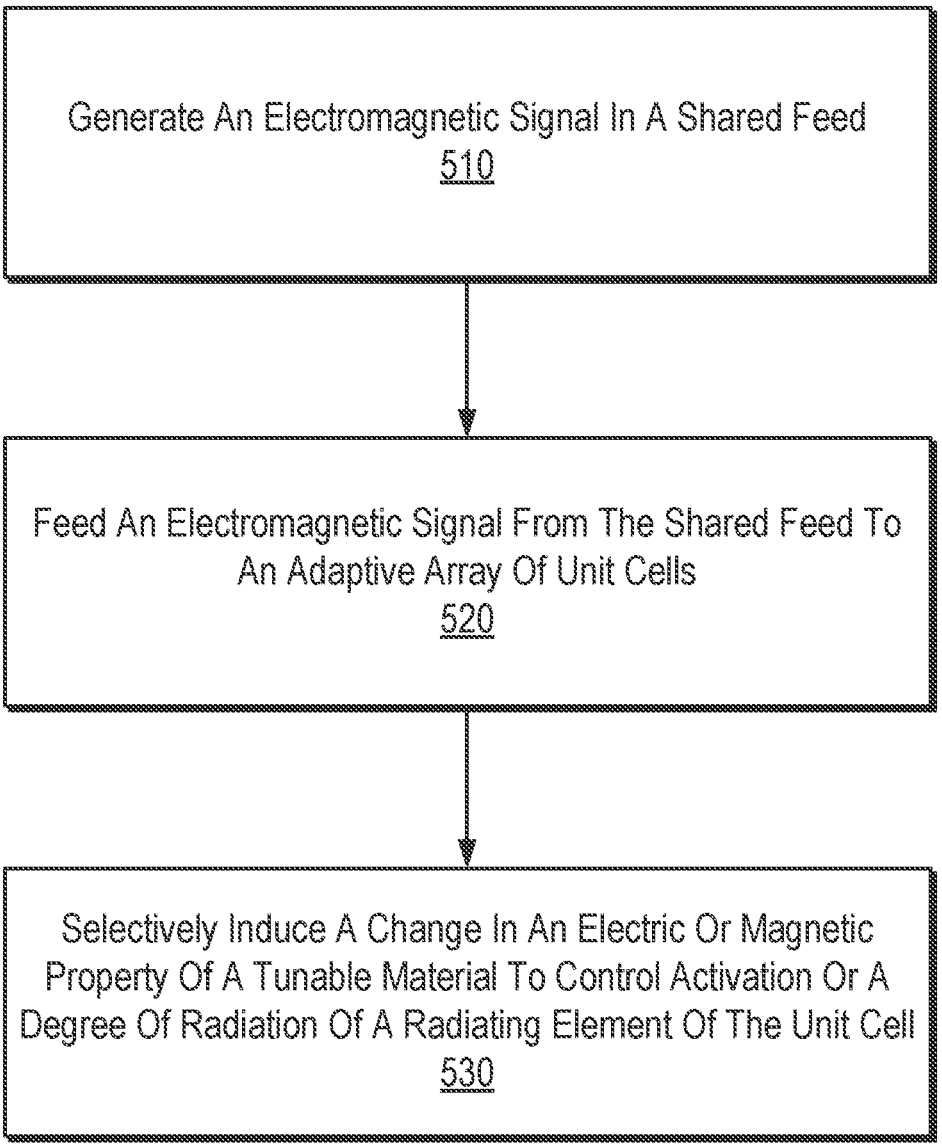
FIG. 5 illustrates a flow chart of another embodiment of a method for reducing signal intermodulation.

FIG. 5 illustrates a flow chart of another method for reducing signal intermodulation. Again, the method illustrated may be computer-implemented via software and a processor or microprocessor. The method may be implemented as stored instructions on a transitory or non-transitory computer-readable medium that, when executed by one or more processors, causes the processor to implement operations corresponding to the methods described herein. The method may be implemented additionally, partially, or alternatively using an application specific integrated circuit, a field-programmable gate array, other hardware circuitry, integrated circuits, software, firmware, and/or a combination thereof.

An electromagnetic signal may be generated 510 in a shared feed. "Generated" is broadly understood to encompass embodiments in which the shared feed receives the electromagnetic signal from an internal or external source. The reception, reflection, refraction, scattering, or the like of the electromagnetic radiation from a source constitutes "generating" as used herein with regard to a shared feed. The electromagnetic signal may be fed 520 from the shared feed to an adaptive array of unit cells. Each unit cell may include a radiating element and an adjustment element co-located with the radiating element.

The adjustment element may include a tunable material, such as a phase and/or state change material or a state change material. A transition control component may selectively induce 530 a change in an electric or magnetic property of the tunable material to control activation or a degree of radiation of the radiating element. Prior to changing the electric or magnetic property of the tunable material, the tunable material may comprise a first phase or a first state that is substantially nonresponsive to electromagnetic fields provided by the shared feed. After the change in the electric or magnetic property of the tunable material, the tunable material may be responsive to electromagnetic fields in a different manner than in the first state.

In various embodiments, a system may be conceptually considered as a plurality of layers and/or physically implemented as a plurality of layers. A first layer may include a shared feed. A second layer may include an array of radiating elements. Each radiating element may be reactively coupled with one or more neighboring radiating elements within the second layer. "Neighboring" broadly includes radiating elements immediately adjacent to a given radiating element as well as other radiating elements that might not be immediately adjacent to the given radiating element.

A third layer may include an array of near-field coupling elements coupled to the radiating elements in the second layer. Each coupling element may be configured to selectively control a field coupling level between one or more radiating elements and the shared feed. A plurality of coupling control components may be adapted to control the field coupling level between the one or more radiating elements. The coupling control components may be substantially nonresponsive to electromagnetic fields provided by the shared feed, radiated by the radiated by the radiating elements, and/or received by the radiating elements within one or more frequency bands of operation.

The term "near-field" may include or be limited to the reactive near-field in some embodiments. All three layers may be separated by a distance that is subwavelength, if not deeply subwavelength, and may therefore within reactive near-field of each other. The layers may be visualized in conjunction with any of FIGS. 1-3, according to some adaptations of the illustrated embodiments.

The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In many instances, well-known structures, materials, or operations are not shown or described in detail to avoid obscuring aspects of this disclosure.

The embodiments of the systems and methods provided within this disclosure are not intended to limit the scope of the disclosure, but are merely representative of possible embodiments. In addition, the steps of a method do not necessarily need to be executed in any specific order, or even sequentially, nor do the steps need to be executed only once. As described above, descriptions and variations described in terms of transmitters are equally applicable to receivers, and vice versa.

This disclosure has been made with reference to various embodiments, including the best mode. However, those skilled in the art will recognize that changes and modifications may be made to the embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. The scope of the present invention should, therefore, be determined by the following claims.

What is claimed is:

1. A system comprising:

a shared feed;

an adaptive array of unit cells including radiating elements, wherein each unit cell comprises a radiating element of the radiating elements and a tunable element co-located with each of the radiating elements;

a bias component to provide a DC bias for each tunable element of corresponding tunable elements of the radiating elements, wherein the DC bias for each tunable element is selected to increase linearity of operation of the tunable elements to reduce signal intermodulation between the radiating elements; and an activation component configured to control activation or a degree of radiation of the radiating elements in response to energy in the shared feed by tuning at least one tunable element of the tunable elements of the radiating elements.

2. The system of claim 1, wherein the shared feed comprises a conductor for conducting time-dependent current signal.

3. The system of claim 1, wherein the radiating elements comprise resonant elements, wherein a tunable element corresponding to a radiating element is configured to modify a response of the resonant elements to the shared feed to control activation or a degree of radiation of the corresponding radiating element.

4. The system of claim 3, wherein each of the tunable elements is configured to adjust a resonant frequency of the corresponding radiating element.

5. The system of claim 4, wherein the tunable element is configured to selectively modify a capacitance or inductance of the radiating element.

6. The system of claim 5, wherein the tunable element comprises a variable capacitor based on a semiconductor junction.

7. The system of claim 3, wherein each of the tunable elements is configured to adjust a quality factor of a resonance of corresponding radiating elements.

8. The system of claim 7, wherein the tunable element comprises a variable resistor.

9. The system of claim 8, wherein the variable resistor comprises a transistor.

10. The system of claim 3, wherein each of the tunable elements is configured to adjust a resonance strength of corresponding radiating elements.

11. The system of claim 3, wherein the tunable element is configured to adjust two or more of a quality factor of a resonance of a corresponding radiating element, a resonant frequency of the corresponding radiating element, and a resonance strength of the corresponding radiating element.

12. A method comprising:

determining a bias for tunable elements for an adaptive array of radiating elements, wherein each radiating element comprises a tunable element co-located with each of the radiating elements, wherein the adaptive array of radiating elements is coupled to a shared feed;

providing a bias for each tunable element, wherein the bias for each tunable element is selected to increase linearity of operation of each tunable element to reduce signal intermodulation between the radiating elements of the adaptive array of radiating elements; and controlling activation or a degree of radiation of the radiating elements in response to energy in the shared feed by tuning at least one tunable element of the tunable elements of the radiating elements.

13. The method of claim 12, wherein the shared feed comprises a transmission line (TL).

14. The method of claim 12, wherein the shared feed comprises a radiator evanescently coupled to the adaptive array of unit cells.

15. The method of claim 12, wherein the radiating elements comprise resonant elements, wherein a tunable element corresponding to a radiating element is configured to modify a response of the resonant elements to the shared feed to control activation or a degree of radiation of the corresponding radiating element.

16. The method of claim 15, wherein each of the tunable elements is configured to adjust a resonant frequency of the corresponding radiating element.

17. The method of claim 16, wherein the tunable element is configured to selectively modify a capacitance or inductance of the radiating element.

18. The method of claim 15, further comprising adjusting a quality factor of a resonance of a corresponding radiating element of each of the tunable elements.

19. The method of claim 15, wherein each of the tunable elements is configured to adjust a resonance strength of the radiating element.

20. The method of claim 15, wherein the tunable element is configured to adjust two or more of a quality factor of a resonance of a corresponding radiating element, a resonant frequency of the corresponding radiating element, and a resonance strength of the corresponding radiating element.

* * * * *